United States Patent [19]

Geiss

[11] 4,011,688

[45] Mar. 15, 1977

[54] DOOR CLOSURE MECHANISM

[75] Inventor: Charles Geiss, Bayport, N.Y.

[73] Assignee: All-Shield Enclosures, Inc., Westbury, N.Y.

[22] Filed: Jan. 16, 1975

[21] Appl. No.: 541,418

[52] U.S. Cl. ..... 49/139; 49/276; 49/394; 292/251

[51] Int. Cl.[2] ..... E05F 11/34

[58] Field of Search ..... 49/139, 276, 394; 292/251, 256.73

[56] References Cited

UNITED STATES PATENTS

| | | | |
|---|---|---|---|
| 2,753,202 | 7/1956 | Smith et al. | 292/251 |
| 3,081,078 | 3/1963 | Lohr | 292/251 X |
| 3,681,873 | 8/1972 | Hansen | 49/139 |

*Primary Examiner*—Kenneth Downey
*Attorney, Agent, or Firm*—S. C. Yuter

[57] ABSTRACT

A door closure mechanism provided with a frame and a door adapted to be closed into the frame in a manner so as to provide RF shielding. The door is provided with a closure mechanism having a motor-driven threaded shaft mounted on a floating platform adapted to have several degrees of freedom with respect to the plane defined by the door. The frame includes a threaded receptacle adapted to receive the threaded shaft. Electrical switches are provided with respect to the door such that the threaded shaft will rotate uon reaching proximity with the threaded receptacle, thereby securing the door to the frame.

8 Claims, 4 Drawing Figures

66
60
100
58
51
54
48
38
74
72
36
43
44
50
34
46
30
56
62
52
64
104
10
12
18

DOOR CLOSURE MECHANISM

BACKGROUND OF THE INVENTION

The present invention relates to door closure mechanisms and more particularly to a shielded door closure having an electrically actuatable door closing drive mechanism.

The manual opening and closing of shielded door enclosures with cranks or handles represent a burden to the operator and also pose significant failure problems with respect to the proper handling of the door and closure mechanism. Extremely bulky and weighty systems of complicated design have been used to overcome extreme door closing pressures and sizes. In addition, extremely accurate hinging and other door closure controls are required in order to insure accurate alignment between the closure inserts which are often employed to assure an extremely RF tight contact between the door and frame. For example, a typical door closure mechanism is shown in the U.S. Pat. No. 3,681,873 issued to Carl Arthur Hanson on Aug. 8, 1972.

It is further desirable with respect to accurate door closure mechanisms that a reliable system of electrical operation be provided but without electrical penetration of the door itself. It is further desirable that electrical operation be initiated from either side of the door, and that emergency cranking or manual door opening be provided as well.

In a co-pending application filed by the inventor of the present invention, and assigned to a common assignee, filed on the same date as this application, a novel and uniquely improved door closure joint is described. In that design, it is desirable that the door be closed into the frame in a manner placing the door as closely positioned to the frame as is possible.

It is therefore the object of the present invention to provide a novel and unique automatic door closure mechanism.

It is another object of the present invention to provide a novel and unique RF shielding door closure mechanism which will permit full insertion of an electrical door blade on an RF shielded door into its appropriate location on the door frame for shielding.

It is another object of the present invention to provide a door closure mechanism with electrical operation but without electrical penetration through the door.

It is another object of the present invention to provide a door closure mechanism which will compensate for minor variations in alignment between the door and the frame and yet insure full closure contact.

SUMMARY OF THE INVENTION

The foregoing objects are realized in accordance with the present invention by providing a door closure mechanism operating with a frame and a door, mounted with respect to the frame so as to have an open and closed position relative thereto. First and second closure members are provided, one of the members being affixed to the door and the other to the frame. The first member includes a threaded shaft mounted on a platform and extending away from the platform towards the second member. The platform is mounted in a manner so as to provide a plurality of degrees of freedom for varying the position of the shaft with respect to the first member. The second member includes a threaded receptacle for receiving the threaded shaft. Means are also provided for rotating the threaded shaft into the threaded receptacle, thereby securing the door to the frame.

In greater detail, the threaded shaft is caused to rotate by an electric motor. The motor is actuated by proximity switches and electrical push button switches for rotating the threaded shaft in the desired direction. The door is provided with nonelectrical penetration by means of a spring-loaded push button for causing actuation of the motor system when the actuation is promoted from the remote side of the door. A platform is provided with a resilient mounting so as to cause it to have a plurality of degrees of freedom with respect to the threaded receptacle, thereby compensating for the lack of alignment. The threaded receptacle may further be provided with a one-way clutch permitting the receptacle to rotate inside the second member after the threaded shaft has been inserted to the limit of the threaded receptacle.

BRIEF DESCRIPTION OF THE DRAWINGS

The foregoing brief description of the present invention, as well as additional features, objects and advantages will become more apparent from the following more detailed description and appended drawings wherein.

DETAILED DESCRIPTION

Figure 1:
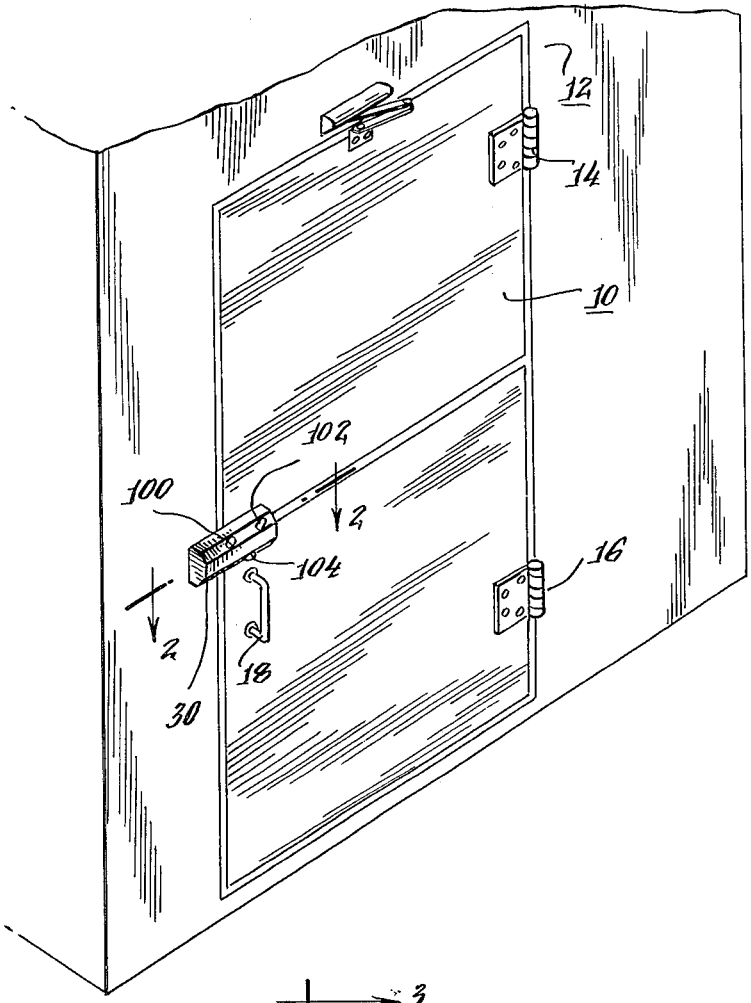
FIG. 1 is an isometric view of a door and door frame employing a closure mechanism.

Referring to FIG. 1, a door 10 is adapted for mounting into a frame 12 by means of suitable hinges 14 and 16. The door 10 is manually opened and closed by means of a handle 18 and closure is effected through the use of a closure mechanism illustrated generally as 20. As shown in greater detail in FIG. 2, the door 10 includes a blade 22 which is inserted into a slot 24 between the first and second finger contacts 26 and 28, all of which is described in greater detail in applicant's concurrently filed co-pending application Ser. No. 541,457. The closure mechanism 20 includes two portions, a first member 30 which is mounted to the door 10 by means of pop rivets, screws or the like, and a second member 32 which is mounted to the surrounding door frame 12. Basic operation of the closure mechanism devolves about the use of a threaded shaft 34 (FIG. 3) which emerges from the first member 30 and is threaded into a similarly threaded receptacle 36 which is formed within a case 38, forming the second member 32. The threaded shaft 34 is driven into and out of closure with the second member 32 by means of an electric motor 40 (FIG. 2) which is coupled to the threaded shaft by means of a worm gear illustrated generally as 42 along the path of a flexible coupling 44.

Figure 3:
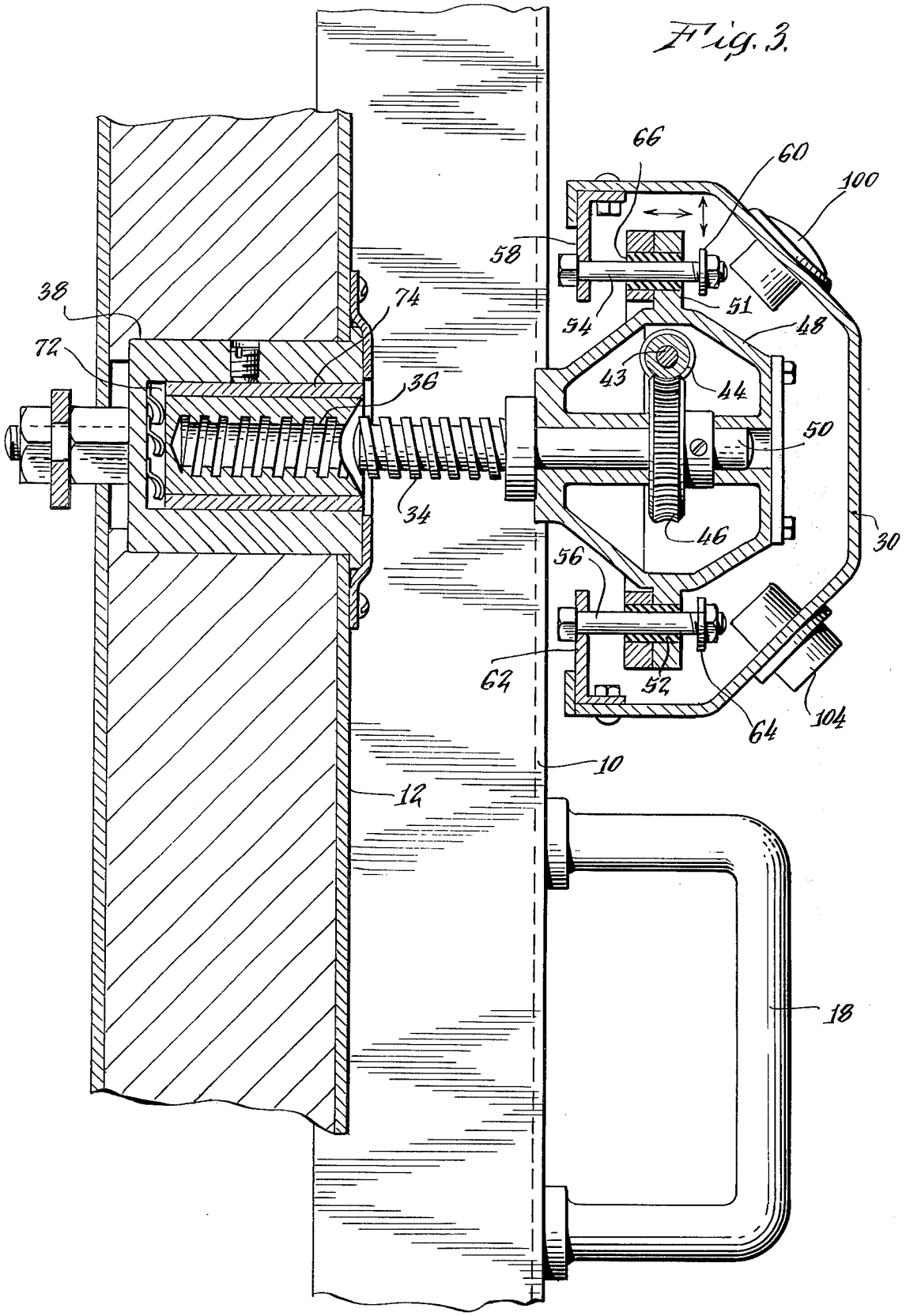
FIG. 3 is a further detail taken along the section lines 3—of FIG. 2.

The flexible shaft is coupled to a threaded member 44 which is in turn driving a circular gear 46 in a conventional worm gear configuration. The circular gear 46 is in turn rotatably mounted to a plate 48 on a central shaft 50 and is in turn coupled to the threaded shaft 34. As shown in FIG. 3, the base plate 48 accommodating the circular gear 46 includes first and second edge mounting holes 51 and 52, respectively. The base plate 48 is secured to the walls of the second member by means of first and second bolts 54 and 56, respectively. The bolts each include a predetermined length thereof defined by washers 58 and 60 with respect to the bolt 54 and washers 62 and 64 with respect to the bolt 56. The mounting holes 51 and 52 in base plate 48 have a diameter substantially in excess of the diameter of the portions of the bolts 54 and 56 between the washers 58 and 60, and 62 and 64, respectively. This difference in spacing is made up by a resilient material 66 with respect to bolt 54 and 68 with respect to bolt 56. For increased stability, a circular support plate 70 is provided on the same resilient surrounding on each of the respective bolts. The base plate 48 and affixed support plate 70 thus each move together. Because of the mounting of the plates 48 and 70 and the resilient materials 66 and 68, which may be a sponge or other like resilient material, base plate 48 will have a plurality of degrees of freedom, A and B, allowing the floating platform defined by the plates 48 and 70 to move over a range determined by the relative diameters, resilience of the material 66, 68, and spacing in the mounting holes relative to the diameter of the bolts coupled thereto. The function of this freedom will allow repositioning and lateral shifting of the floating platform, and provide an advantageous effect evident from the necessity of alignment of the threaded shaft 34 and the threaded receptacle 36. Thus, in operation, should there be a misalignment in the axes of the respective mating components 34 and 36, a shifting of the base plate 48 will take place against the resilience of the material securing it to the respective mounting bolts 54 and 56 to compensate for the lack of alignment. Thus, a lack of alignment will be compensated for without jamming or otherwise destroying the mechanism.

After insertion of the threaded shaft 34 into the receptacle 36, and actuation of the motor drive, the threaded shaft 34 will rotate into the threaded receptacle 36, thus securing the door 10 to the frame 12. The spacing of the floating platform on the bolts 54 and 56 allows for a certain amount of forward and backward movement of the platform before the door itself begins to move. This linear play permits the floating platform to set itself in proper position before the actual weight of the door is engaged.

Should the mechanism not properly function, or for any other reason should the threaded shaft 34 bind into the threaded receptacle 36, a one-way clutch 72 is provided. The function of the one-way clutch 72 is to mount the threaded receptacle 36 and its associated casing 74 into the second member 38 in a manner causing rotation of the entire casing 74 within the second member 38. Rotation of the casing causes the threaded insert 36 to rotate accordingly, and thus continued rotation of the threaded insert 34 will cause no damage to the threaded receptacle. Suitable alarms may be provided to indicate this condition, which would normally indicate some form of malfunction. Thus function may also provide a system shut-off signal, by indicating full insertion.

Referring again to FIG. 2, an emergency cranking mechanism is illustrated. The emergency cranking mechanism 80 includes a handle 82 mounted at the periphery of a rotating platform 84 for rotating a central shaft 86 which in turn rotates the second member 38 through the clutching mechanism 72. As a result, the threaded shaft 34 positioned in the threaded insert 36 will be driven out of the receptacle 36 by means of the reverse turning action of the case enclosing the threaded receptacle 36. In this manner, the door may be opened in a nonelectrical fashion.

Figure 2:
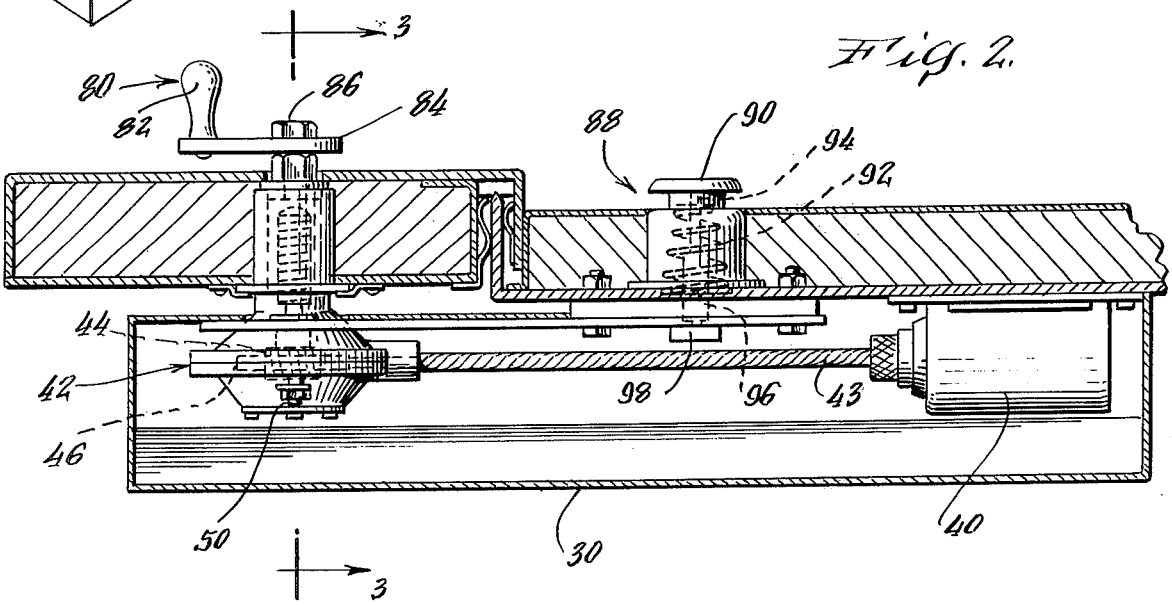
FIG. 2 is a cross-section of a closure mechanism taken along the lines 2—2 of FIG. 1.

Also shown in FIG. 2 is an electrical means for opening the door from the remote side of the door relative to the motor drive. As shown, the mechanism is a push button mechanism illustrated generally as 88 and including a button 90 positioned on a spring loaded return 92 for urging the button into a normally up position. The button is mounted to a nonelectrical rod 94 which may be phenolic or other plastic material with suitable nonelectrical characteristics. The rod passes through the door by means of a wave guide 96 which is mounted in the door in a penetrating manner. After penetrating the door through the wave guide, the rod 94 passes into the first member casing and activates an electrical switch 98 which may be a microswitch or the like for activating the motor drive. By providing a wave guide passage, instead of an electrical lead-through, the RF integrity of the enclosure is maintained, and maximum RF attenuation is achieved.

Electrically, the system includes several features including proximity activation, remote switching activation, such as photocells, floormats, or the like, and automatic start-up and shut-down of the motor drive. In addition, control lights are employed to indicate opening and closing conditions. Referring briefly to FIG. 1, two lights 100 and 102 are illustrated on the upper portion of the casing. The light 100 may be employed to indicate the doors in an open condition and the light 102 indicating the doors in a closed condition. A push-button 104 is also provided on the cover of the closure mechanism, conveniently positioned just above the handle for thumb activation, for activating a door opening condition.

Figure 4:
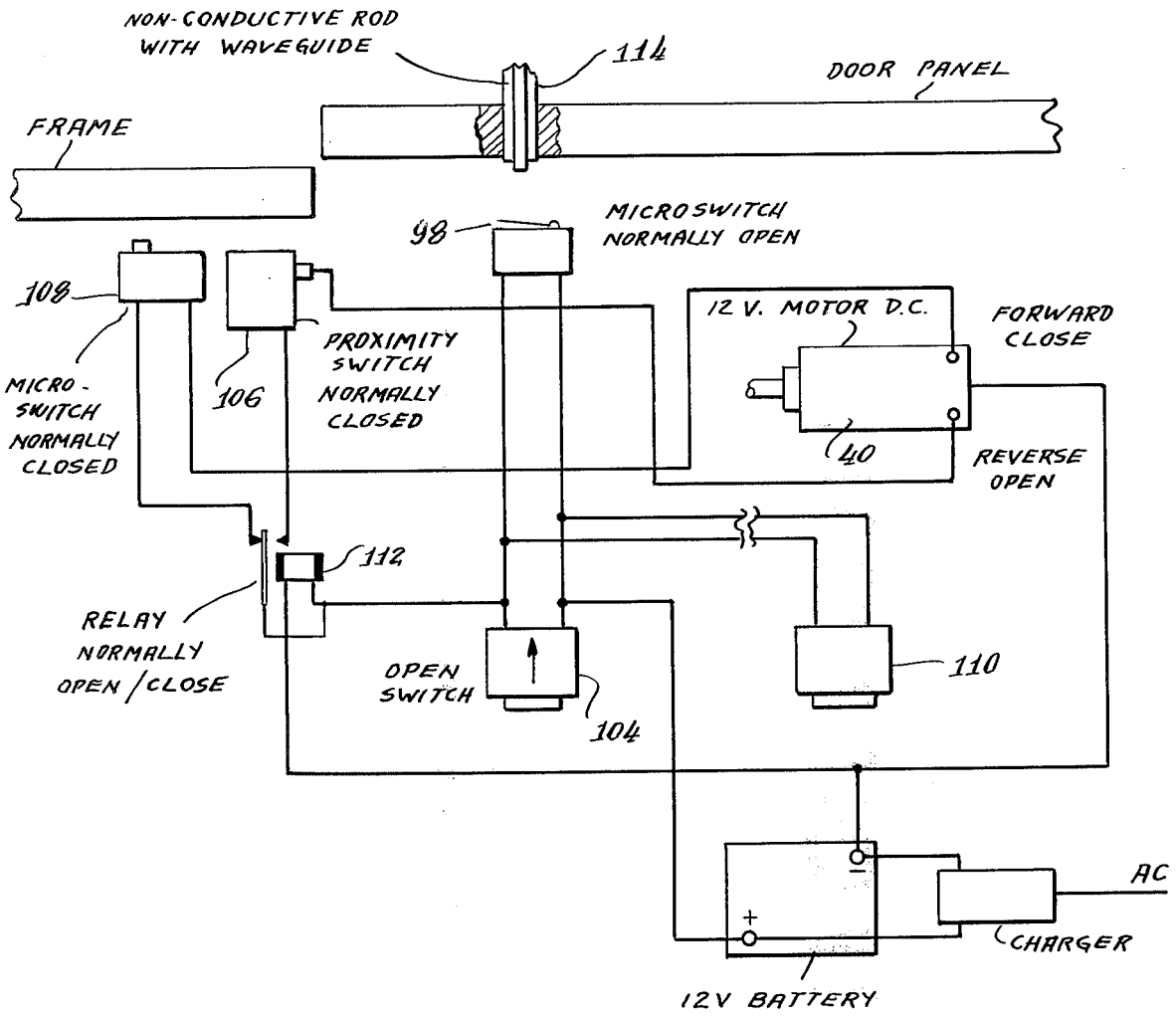
FIG. 4 is an electrical schematic illustrating the operation of the various mechanisms of the door closure.

Referring to FIG. 4, a simplified electrical diagram illustrating the relationship between the various components is shown. More specifically, a proximity switch 106 and microswitch 108 are positioned within the first member as shown in FIG. 2 for activating the motor by connecting same to the battery supply via an electrical relay 112 which is latchable in either open or closed position, shown electrically in FIG. 4. When the door is put into a closing position, automatically or by manually grasping the handle 18 and moving the door towards the frame, and when the door has reached the point where the threaded shaft is almost in contact with the threaded receptacle, the proximity switch activates the circuit, thereby driving the motor for turning the threaded shaft and engaging the receiving receptacle for closing the door. When the door is fully closed, the microswitch 108 is switched, breaking the closing circuit. For reopening the door, activation of the push-button 104 will switch the relay to its open position and start the motor running in its opposite direction, thereby opening the door away from the frame. The proximity switch again comes into play when the threaded shaft has completely removed itself from its threaded receptacle to open the opening circuit, thereby disabling the drive system. Activation of the microswitch 98 in conjunction with a waveguide penetration and nonconductive rod 114 from the remote side of the door will also give rise to an activation of the motor drive, thereby opening the door as well. Finally, remote control switches shown generally as 110 and which might include floormat activators, photocell activators or the like also serve to optionally activate the motor drive for opening or closing the door.

The motor may be driven by any suitable supply source. The use of a 12 volt standard battery as a standby or main power source is preferred, thereby providing substantially uninterruptable power for emergency operation.

Although proximity switching has been described, it is obvious that contact microswitches may also be employed to control the switching operation. It is further noted that although the offset finger and blade insertion system is shown as the manner of sealing the door, that other manners of sealing the door may be employed in connection with the motor driven system of the present invention.

Summarizing, it is therefore evident that what has been disclosed is a novel and unique door closure mechanism employing a bi-directional motor with a flexible drive shaft operable with a DC source for continuity as well as with any other power source for driving purposes. By providing a worm drive with a floating mount to allow for positive engagement, the driver insures adequate closure under all types of alignment conditions. The mechanism is relatively simple in construction thereby giving rise to light weight, reliability and minimized parts. Emergency features such as manual operation and indicator lights are also easily employed within the framework of the inventive concept.

Other variations, modifications, substitutions, alterations and/or omissions will be evident to those skilled in the art.

What is claimed is:

1. In a radiation attenuating door closure mechanism, the improvement comprising, a frame, a door mounted with respect to said frame so as to have an open and closed position relative to said frame, first and second closure members designed to close in axial alignment along their respective central axes, one of said members affixed to said door, the other of said member to said frame, said first member including a threaded shaft mounted on a floating platform and extending from said platform, said shaft mounted for positioning of its longitudinal axis in a direction generally normal to said door and frame, said platform mounted on a flexible support, said flexible support providing a plurality of degrees of freedom for varying the position of said platform with respect to said first member such that said shaft axis is self-aligning with said second member central axis, said second member including a threaded receptacle aligned with and forming said central axis of said second member for receiving said threaded shaft, and means for rotating said threaded shaft into said threaded receptacle, thereby drawing and securing said door to said frame.

2. The mechanism of claim 1, wherein said first member includes an electric motor having a flexible rotating shaft for causing rotation of said threaded shaft, said flexible rotating shaft coupled through a worm drive to said threaded shaft.

3. The mechanism of claim 2, wherein said motor is actuated by a proximity switch detecting when said first member is proximate said second member for rotating said threaded shaft in a direction closing said door into said frame.

4. The mechanism of claim 2, wherein said motor is actuated by a push button mechanism for rotating said threaded shaft in a direction releasing said door from said frame.

5. The mechanism of claim 4, wherein said push button is positioned on the opposite side of said door relative to said first member and includes a nonconductive rod penetrating said door through a wave guide for actuating a further switching means, said further switching means closing the electrical circuit for actuating said motor.

6. The mechanism of claim 1, wherein said platform includes a base plate having a pair of mounting holes, a pair of mounting bolts fixed to said first member and securing said base plate by passing through said mounting holes, said bolts including central shafts of substantially lesser diameter than said mounting holes, the remaining volume between said shafts and the inner wall of said mounting holes being filled with resilient material, said threaded shaft being rotatably secured to said base plate and flexibly coupled to said means for rotation, said shaft thereby having a plurality of degrees of freedom with respect to the normal plane of said base plate through said resilient material.

7. The mechanism of claim 1, wherein said threaded receptacle is mounted into said second member by a one way clutch, said clutch permitting said receptacle to rotate in said second member when said threaded shaft has been fully inserted into said threaded receptacle.

8. The mechanism of claim 7, wherein said second member further includes a hand operated crank mounted to said second member for rotating said threaded receptacle in a manner whereby said threaded shaft is ejected from said receptacle, thereby opening said door from said frame.

* * * * *